US009640354B2

(12) United States Patent
Nishimura et al.

(10) Patent No.: US 9,640,354 B2
(45) Date of Patent: May 2, 2017

(54) CONTACT DEVICE

(71) Applicant: Panasonic Intellectual Property Management Co., Ltd., Osaka (JP)

(72) Inventors: Tsukasa Nishimura, Hokkaido (JP); Ritsu Yamamoto, Mie (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/423,353

(22) PCT Filed: Aug. 20, 2013

(86) PCT No.: PCT/JP2013/004904

§ 371 (c)(1),
(2) Date: Feb. 23, 2015

(87) PCT Pub. No.: WO2014/030337

PCT Pub. Date: Feb. 27, 2014

(65) Prior Publication Data

US 2015/0255235 A1 Sep. 10, 2015

(30) Foreign Application Priority Data

Aug. 23, 2012 (JP) ..... 2012-183913
Aug. 23, 2012 (JP) ..... 2012-183914

(51) Int. Cl.
*H01H 3/00* (2006.01)
*H01H 50/60* (2006.01)
(Continued)

(52) U.S. Cl.
CPC ..... *H01H 50/60* (2013.01); *H01H 50/546* (2013.01); *H01H 1/50* (2013.01);
(Continued)

(58) Field of Classification Search
CPC ..... H01H 50/04; H01H 50/22; H01H 50/30; H01H 50/34; H01H 50/36; H01H 50/54;
(Continued)

(56) References Cited

U.S. PATENT DOCUMENTS 5,734,308 A * 3/1998 Dittmann ..... H01H 50/36 335/128
5,892,194 A * 4/1999 Uotome ..... H01H 1/34 218/68
(Continued)

FOREIGN PATENT DOCUMENTS

CN 1698149 A 11/2005
CN 102292789 A 12/2011
(Continued)

OTHER PUBLICATIONS

Chinese Search Report issued in Chinese Application No. 201380044111.6 dated Mar. 2, 2016, with English Translation.
(Continued)

*Primary Examiner* — Shawki S Ismail
*Assistant Examiner* — Lisa Homza
(74) *Attorney, Agent, or Firm* — McDermott Will & Emery LLP

(57) ABSTRACT

In a contact device, rotational movement of a movable contactor with a yoke attached is regulated by the fact that the yoke abuts against a wall surface of a wall portion. In an event where the movable contactor with the yoke attached moves rotationally, the yoke is allowed to abut against only a wall surface in one region obtained by dividing the wall surface by a virtual line passing through a rotation center of the yoke.

13 Claims, 6 Drawing Sheets

(51) Int. Cl.
*H01H 50/54* (2006.01)
*H01H 1/50* (2006.01)
*H01H 9/44* (2006.01)
*H01H 50/04* (2006.01)
*H01H 51/06* (2006.01)

(52) U.S. Cl.
CPC ..... *H01H 9/443* (2013.01); *H01H 50/04* (2013.01); *H01H 51/065* (2013.01)

(58) Field of Classification Search
CPC ..... H01H 50/643; H01H 2050/362; H01H 2235/01
USPC ..... 335/171
See application file for complete search history.

(56) References Cited

U.S. PATENT DOCUMENTS 8,138,863 B2 * 3/2012 Tanaka ..... H01H 1/54 335/126
8,138,872 B2 * 3/2012 Yoshihara ..... H01F 7/1615 335/124
8,179,217 B2 * 5/2012 Kawaguchi ..... H01F 7/1615 335/124
8,198,964 B2 * 6/2012 Yoshihara ..... H01H 51/29 335/131
8,274,347 B2 * 9/2012 Eum ..... H01H 9/341 335/156
8,549,734 B2 * 10/2013 Yeon ..... H01H 49/00 218/118
8,797,129 B2 * 8/2014 Naka ..... H01H 50/36 335/126
9,117,611 B2 * 8/2015 Naka
2004/0027776 A1 * 2/2004 Uotome ..... H01H 47/06 361/160
2005/0190025 A1 9/2005 Yamamoto et al.
2007/0241847 A1 * 10/2007 Yamamoto ..... H01H 50/305 335/196
2007/0284234 A1 12/2007 Kurasawa et al.
2009/0066450 A1 * 3/2009 Yano ..... H01H 49/00 335/203
2009/0102583 A1 * 4/2009 Nakamura ..... H01H 50/54 335/5
2009/0243771 A1 * 10/2009 Uruma ..... H01H 50/04 335/193
2009/0261928 A1 * 10/2009 Nakamura ..... H01H 50/041 335/147
2009/0322454 A1 12/2009 Tanaka et al.
2011/0032059 A1 * 2/2011 Ito ..... H01H 9/34 335/202
2012/0139670 A1 * 6/2012 Yamagata ..... H01H 50/023 335/2
2013/0012037 A1 1/2013 Enomoto et al.
2013/0057369 A1 * 3/2013 Yano ..... H01H 1/66 335/156
2013/0234811 A1 * 9/2013 Nishimura ..... H01H 50/643 335/189
2014/0184366 A1 * 7/2014 Ito ..... H01H 50/54 335/189
2015/0077202 A1 * 3/2015 Enomoto ..... H01H 1/50 335/171
2016/0155592 A1 * 6/2016 Ito ..... H01H 50/36 335/187

FOREIGN PATENT DOCUMENTS

EP 2381459 A1 10/2011
JP 02-103836 A 4/1990
JP 2005-038706 A 2/2005
JP 2007-335117 A 12/2007
JP 2010-010056 A 1/2010
JP 2011-204478 A 10/2011
JP 2011-204479 A 10/2011
JP 2012-104364 A 5/2012

OTHER PUBLICATIONS

Extended European Search Report issued in Application No. 13830664.2 dated Jul. 24, 2015.
International Search Report issued in PCT/JP2013/004904, dated Sep. 17, 2013, with English translation.

* cited by examiner

CONTACT DEVICE

RELATED APPLICATIONS

This application is the U.S. National Phase under 35 U.S.C. §371 of International Application No. PCT/JP2013/004904, filed on Aug. 20, 2013, which in turn claims the benefit of Japanese Application No. 2012-183913, filed on Aug. 23, 2012 and Japanese Application No. 2012-183914, filed on Aug. 23, 2012, the disclosures of which Applications are incorporated by reference herein.

TECHNICAL FIELD

The present invention relates to a contact device.

BACKGROUND ART

Heretofore, as a contact device, there has been known one in which a movable contactor is arranged on one end portion of a drive shaft that reciprocally moves in an axial direction based on magnetization and demagnetization of an electromagnet block (for example, refer to Patent Literature 1).

In this Patent Literature 1, movable contact points, which individually contact and leave a pair of fixed contact points provided in parallel to each other, are provided on both end portions of the movable contactor, and the movable contact points are configured to contact and leave the fixed contact points following movement of the movable contactor.

Then, the movable contactor is sandwiched by a first yoke and a second yoke, whereby a magnetic circuit is formed between the first yoke and the second yoke. In this way, a malfunction is solved, which is caused by electromagnetic repulsive force acting between the fixed contact points and the movable contact points in an event where an abnormal current flows in a contact point ON state.

The malfunction, which is caused by the electromagnetic repulsive force acting between the fixed contact points and the movable contact points, specifically refers to a problem as described below.

When the abnormal current flows in the contact point ON state, and the electromagnetic repulsive force acts between the fixed contact points and the movable contact points, then a contact point pressure is lowered, and a contact resistance is increased, resulting in a sharp increase of Joule heat, and the contact points are opened and separated from each other, resulting in generation of arc heat. Therefore, it is apprehended that the movable contact points and the fixed contact points may be welded to each other.

However, if the first and second yokes are provided on the movable contactor, then the first and second yokes generate magnetic force to suck each other based on the abnormal current flowing in the contact point ON state, and become able to regulate such an operation that the movable contactor is going to be opened and separated from the fixed contact points. Then, this regulation of the operation that the movable contactor is going to be opened and separated from the fixed contact points allows the movable contact points to stick to the fixed contact points without allowing the movable contactor to repel the fixed contact points, and accordingly, an occurrence of an arc is suppressed.

As described above, in Patent Literature 1, the first and second yokes are provided on the movable contactor, whereby an overcurrent capacity is increased, thus enabling to suppress the contact points from being welded to each other owing to the occurrence of the arc.

CITATION LIST

Patent Literature

Patent Literature 1: Japanese Patent Application Publication No. 2010-010056

SUMMARY OF INVENTION

Technical Problem

However, in the above-described conventional technology, the movable contactor to which the first and second yokes are attached is reciprocally moved in a state of being housed in a sealed case. Then, the drive shaft is provided on a center of the movable contactor to which the first and second yokes are attached, and the drive shaft is arranged so as to be located at a center of the sealed case. Therefore, in a case where the movable contactor moves rotationally in some direction in an event of moving reciprocally, it is apprehended that end portions arranged diagonally on the movable contactor or the first and second yokes may abut against wall surfaces of the sealed case, which are opposite to each other. As described above, if the end portions arranged diagonally abut individually against the wall surfaces of the sealed case, which are opposite to each other, operation characteristics of the movable contactor are deteriorated.

In this connection, it is an object of the present invention to obtain a contact device capable of ensuring the operation characteristics of the movable contactor more surely.

Solution to Problem

A first feature of the present invention is a contact device including: a movable contactor; a yoke that is attached to the movable contactor and forms a magnetic circuit; and a wall portion arranged to surround outer peripheries of the movable contactor and the yoke, and is that rotational movement of the movable contactor with the yoke attached is regulated by a fact that the yoke abuts against a wall surface of the wall portion, and in an event where the movable contactor with the yoke attached moves rotationally, the yoke is allowed to abut against only a wall surface in one region obtained by dividing the wall surface by a virtual line passing through a rotation center of the yoke.

A second feature of the present invention is that, in whichever direction the movable body with the yoke attached may rotationally move, the yoke is allowed to abut against only the wall surface in the one region.

A third feature of the present invention is that the wall surface against which the yoke abuts does not have a bent portion.

A fourth feature of the present invention is that a shape profile of the wall surface is polygonal, and the yoke is allowed to abut against only a wall surface of the wall portion, the wall surface composing one side of the polygonal shape.

A fifth feature of the present invention is that the shape profiles of the wall surface and the yoke are quadrangular, and a distance of an edge of the yoke, the edge being opposite to one wall surface of four wall surfaces of the wall surface, to the rotation center and a distance of an edge of the yoke, the edge being opposite to a wall surface opposite with the one wall surface, to the rotation center are different from each other.

A sixth feature of the present invention is that, on the edge opposite to the one wall surface of the four wall surfaces of the wall surface, a protrusion portion that protrudes on the one wall surface side is provided.

A seventh feature of the present invention is that the yoke includes: a first yoke that abuts against the wall surfaces; and a substantially U-like second yoke arranged to surround the movable contactor, and a side of the first yoke in the one region, the side being opposite to the wall surface against which the first yoke abuts, protrudes more on the wall surface side than the second yoke when viewed from above.

An eighth feature of the present invention is that the wall surface in the one region includes wall surfaces opposite to each other, the yoke abuts against only one wall surface of the wall surfaces opposite to each other in an event where the movable contactor with the yoke attached rotationally moves to one side, and the yoke abuts against only other wall surface of the wall surfaces opposite to each other in an event where the movable contactor with the yoke attached rotationally moves to other side.

A ninth feature of the present invention is that the shape profiles of the wall surface and the yoke are quadrangular, and a distance of an edge of the yoke, the edge being opposite to a wall surface in the one region, to the rotation center and a distance of an edge of the yoke, the edge being opposite to a wall surface in other region, to the rotation center are different from each other.

A tenth feature of the present invention is that, on the edge opposite to the wall surface in the one region, protrusion portions which protrude to a mutually opposite wall surface side in the one region are individually provided.

An eleventh feature of the present invention is that the yoke includes: a first yoke that has a quadrangular shape profile and abuts against the wall surfaces; and a substantially U-like second yoke arranged to surround the movable contactor, and the shape profile of the first yoke has a trapezoidal shape in which a width between edges on the one region side is made wider than a width between edges on the other region.

A twelfth feature of the present invention is that the edges of the first yoke on the one region side protrude more on the mutually opposite wall surface side in the one region than the second yoke.

Advantageous Effects of Invention

According to the present invention, in the event where the movable contactor with the yoke attached moves rotationally, the yoke is allowed to abut against only the wall surface in the one region obtained by dividing the wall surface by the virtual line passing through the rotation center of the yoke. By adopting such a configuration, the yoke can be prevented from abutting against the wall surfaces at two spots arranged so as to sandwich the rotation center therebetween. As a result, the operation characteristics of the movable contactor are suppressed from being deteriorated, and it becomes possible to more surely ensure the operation characteristics of the movable contactor.

BRIEF DESCRIPTION OF DRAWINGS

FIG. 1(*a*) is a side cross-sectional view; and FIG. 1(*b*) is a side cross-sectional view cut in a direction perpendicular to a cut-plane direction of FIG. 1(*a*).

FIG. 2(*a*) is a perspective view enlargedly showing a main portion of the contact point unit; and FIG. 2(*b*) is a cross-sectional view schematically showing an arrangement relationship between upper and lower yokes and a movable contactor.

FIG. 5(*a*) is a back view showing a state where the upper yoke does not rotationally move relatively to the lower yoke; and FIG. 5(*b*) is a back view showing a state where the upper yoke rotationally moves relatively to the lower yoke.

FIG. 6(*a*) is a back view showing a state where the upper yoke does not rotationally move relatively to the lower yoke; and FIG. 6(*b*) is a back view showing a state where the upper yoke rotationally moves relatively to the lower yoke.

FIG. 9(*a*) is a back view showing a state where the upper yoke does not rotationally move relatively to the lower yoke; and FIG. 9(*b*) is a back view showing a state where the upper yoke rotationally moves relatively to the lower yoke.

FIG. 10(*a*) is a back view showing a state where the upper yoke does not rotationally move relatively to the lower yoke; and FIG. 10(*b*) is a back view showing a state where the upper yoke rotationally moves relatively to the lower yoke.

DESCRIPTION OF EMBODIMENTS

Figure 1:
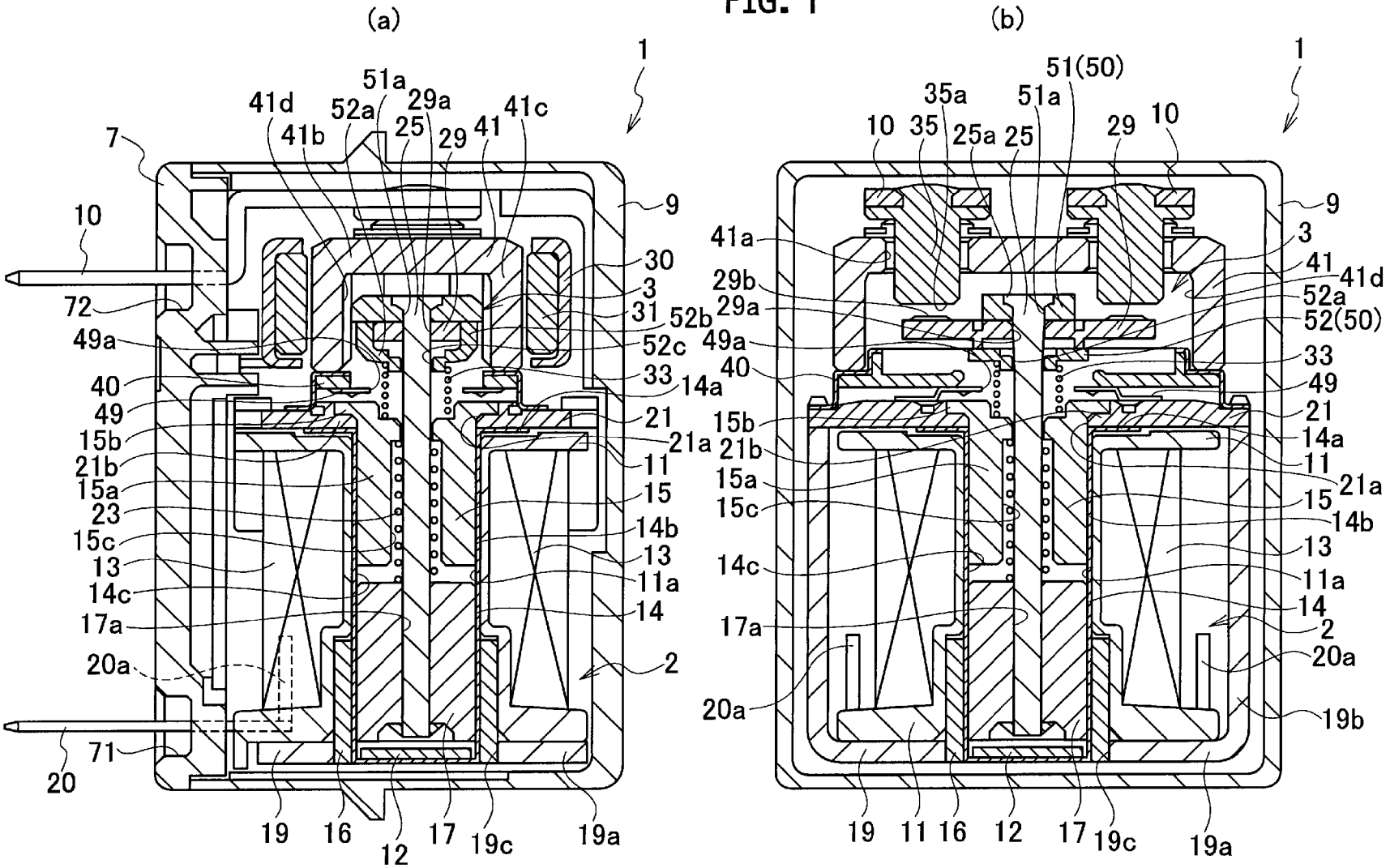
FIGS. 1(*a*) and 1(*b*) are views showing a contact device according to a first embodiment of the present invention.

A description is made below in detail of embodiments of the present invention while referring to the drawings. Note that similar constituent elements are included in pluralities of the following embodiments and modification examples. Hence, in the following, common reference numerals are assigned to those similar constituent elements, and in addition, a duplicate description is omitted.

First Embodiment

Figure 2:
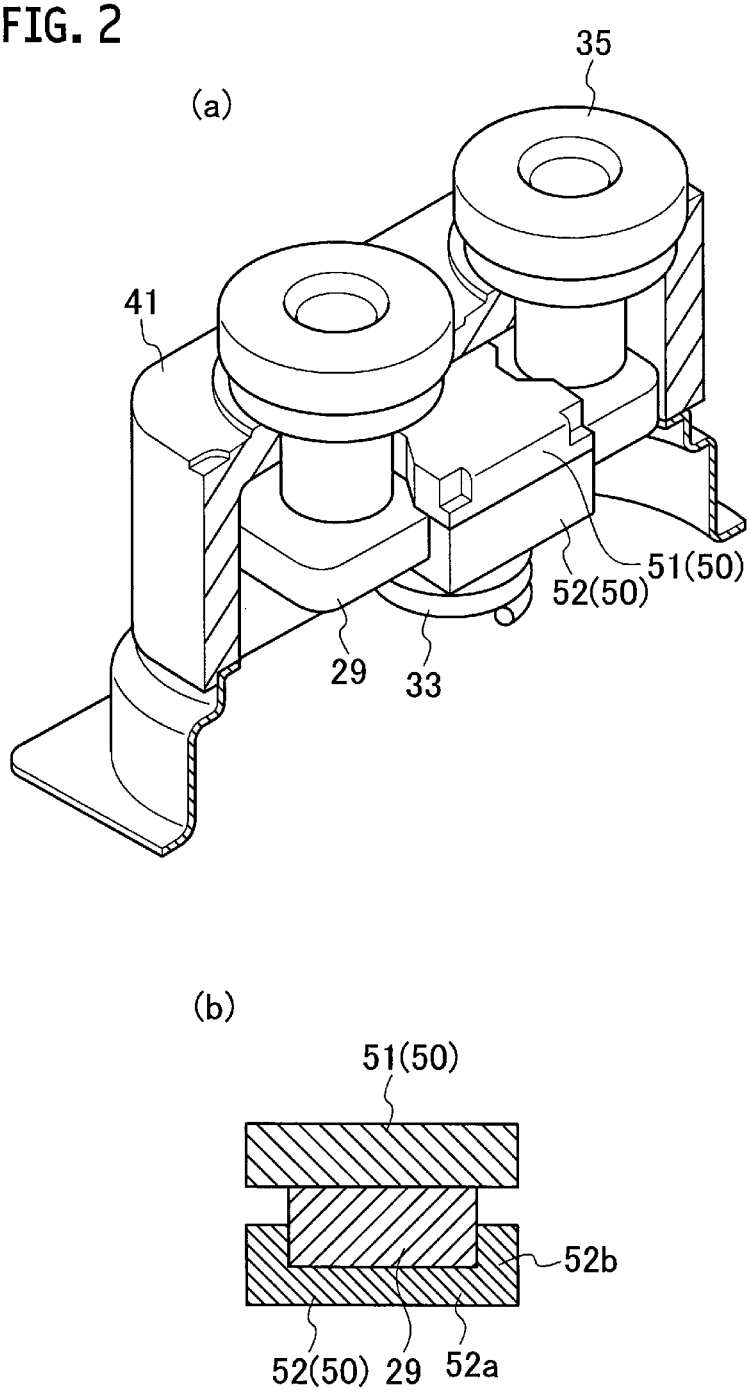
FIGS. 2(*a*) and 2(*b*) are views schematically showing a contact point unit of the contact device according to the first embodiment of the present invention.

First, with reference to FIGS. 1(*a*) and 1(*b*) and FIGS. 2(*a*) and 2(*b*), a description is made of a schematic configuration of a contact device 1 according to an embodiment of the present invention.

The contact device 1 of this embodiment is applied to an electromagnetic relay. The contact device 1 includes: a drive unit 2 located on a lower portion thereof in FIGS. 1(*a*) and 1(*b*); and a contact point unit 3 located on an upper portion thereof, and these drive unit 2 and contact point unit 3 are housed in a case.

The case includes: a case base portion 7 having a substantially rectangular shape; and a case cover 9, which is arranged so as to cover this case base portion 7 and houses mounted components such as the drive unit 2 and the contact point unit 3 therein. In the case base portion 7, a pair of slits 71 and 71, to which a pair of coil terminals 20 are individually attached, are provided on such a lower portion side thereof in FIGS. 1(*a*) and 1(*b*). Moreover, in the case base portion 7, a pair of slits 72 and 72, to which a pair of main terminals 10 and 10 are attached, are individually provided on such an upper portion side thereof in FIGS. 1(*a*) and 1(*b*). Meanwhile, the case cover 9 is formed into a hollow box shape in which a case base portion 7 side is opened.

The drive unit 2 includes a coil 13 wound around a coil bobbin 11, and a plunger cap 14 is arranged in a through hole 11*a* formed in a center of the coil bobbin 11. At this time, an annular seat surface (not shown) is formed on an upper side of the coil bobbin 11, and a flange portion 14*a* of the plunger cap 14 is mounted on this seat surface. Then, a protrusion portion 14*b* of the plunger cap 14 is fitted to the through hole 11*a*. In the pair of coil terminals 20, relay terminals 20*a* are individually formed, and to the respective relay terminals 20*a*, leader lines on both ends of the coil 13 wound around the coil bobbin 11 are individually tied and soldered.

Moreover, a through hole 14*c* is formed in a center of the plunger cap 14. On an upper side in this through hole 14*c*, a fixed iron core 15 as a fixed member is arranged, and on a lower side therein, a movable iron core 17 as a movable member is arranged. On a further lower side of the movable iron core 17, a rubber cushion 12 is arranged.

A yoke 19 is arranged between the coil 13 and the case. The yoke 19 includes: a bottom wall 19*a*; and a pair of sidewalls 19*b* and 19*b* erected from a peripheral edge of the bottom wall 19*a*. In the bottom wall 19*a* of the yoke 19, an annular through hole 19*c* is formed, and a bush 16 is attached to this through hole 19*c*.

Then, on a tip end side (upper end side) of the pair of sidewalls 19*b* and 19*b* of the yoke 19, a yoke upper plate 21 is arranged so as to cover the coil 13 wound around the coil bobbin 11.

The fixed iron core 15 is fixed in such a manner that a protrusion portion 15*a* is fitted to a through hole 21*a* of the yoke upper plate 21 and to the through hole 14*c* of the plunger cap 14, and that a flange portion 15*b* is mounted on a seat surface 21*b* formed on an upper portion of the yoke upper plate 21. Meanwhile, the movable iron core 17 located under the fixed iron core 15 is arranged so as to be movable to approach and leave the fixed iron core 15 in the through hole 14*c* of the plunger cap 14.

A through hole 15*c* and a through hole 17*a* are formed in the fixed iron core 15 and the movable iron core 17, respectively, and a return spring 23 is arranged between the fixed iron core 15 and the movable iron core 17. By this return spring 23, the movable iron core 17 is urged in a direction (upper side in FIGS. 1(*a*) and 1(*b*)) of leaving the fixed iron core 15.

Then, one end portion of an upper side of the return spring 23 is allowed to abut against a presser plate 49 fixed to an upper side of the yoke upper plate 21. Note that, preferably, a rubber cushion is arranged between the presser plate 49 and the fixed iron core 15.

Moreover, in the movable iron core 17, a shaft 25 is provided so as to extend along a moving direction of the movable iron core 17, and a movable contactor 29 is attached to one end portion on an upper side of the shaft 25. Movable contact points 29*b* are provided on the movable contactor 29, and these movable contact points 29*b* are enabled to contact and leave fixed contact points 35*a* of fixed terminals 35 to be described later.

Incidentally, when a large current flows between the movable contact points 29*b* of the movable contactor 29 and the fixed contact points 35*a* and 35*a* in a state where the movable contact points 29*b* of the movable contactor 29 and the fixed contact points 35*a* and 35*a* are in contact with each other, electromagnetic repulsive force acts between the fixed contact points 35*a* and 35*a* and the movable contactor 29 by this large current. When the electromagnetic repulsive force acts between the fixed contact points 35*a* and 35*a* and the movable contactor 29, a contact point pressure is lowered, and a contact resistance is increased, resulting in a sharp increase of Joule heat, and the contact points are opened and separated from each other, resulting in generation of arc heat. Therefore, it is apprehended that the movable contact points 29*b* and the fixed contact points 35*a* may be welded to each other.

Accordingly, in this embodiment, a yoke 50 is provided so as to surround the movable contactor 29. Specifically, an upper yoke (first yoke) 51, which is arranged on the movable contactor 29, and a lower yoke (second yoke), which surrounds a lower side and side portion of the movable contactor 29, compose the yoke 50 that surrounds upper and lower surfaces and side surface of the movable contactor 29. As described above, the movable contactor 29 is surrounded by the upper yoke 51 and the lower yoke 52, whereby a magnetic circuit is formed between the upper yoke 51 and the lower yoke 52.

Then, the upper yoke 51 and the lower yoke 52 are provided, whereby, in such an event where the large current flows between the movable contact points 29*b* and the fixed contact points 35*a* and 35*a* when both of which contact each other, the upper yoke 51 and the lower yoke 52 generate magnetic force to suck each other based on the large current. As described above, the magnetic force to suck the upper yoke 51 and the lower yoke 52 each other is generated, whereby the upper yoke 51 and the lower yoke 52 suck each other. By the fact that the upper yoke 51 and the lower yoke 52 suck each other, the movable contactor 29 is pressed against the fixed contact points 35*a*, and such an operation that the movable contactor 29 is going to be opened and separated from the fixed contact points 35*a* is regulated. As described above, the operation that the movable contactor 29 is going to be opened and separated from the fixed contact points 35*a* is regulated, whereby the movable contact points 29*b* stick to the fixed contact points 35*a* without allowing the movable contactor 29 to repel the fixed contact points 35*a*, and accordingly, an occurrence of an arc is suppressed. As a result, it becomes possible to suppress the contact points from being welded to each other owing to the occurrence of the arc.

Moreover, in this embodiment, the upper yoke 51 is formed into a substantially rectangular plate shape, and the lower yoke 52 is formed into a substantially U-shape from a bottom wall portion 52*a* and sidewall portions 52*b* formed so as to be erected from both ends of the bottom wall portion 52*a*. At this time, as shown in FIG. 1(*a*), it is preferable to allow upper end surfaces of the sidewall portions 52*b* of the lower yoke 52 to abut against a lower surface of the upper yoke 51; however, as shown in FIG. 2, upper end surfaces of the sidewall portions 52*b* of the lower yoke 52 may be allowed not to abut against the lower surface of the upper yoke 51.

Moreover, a flange portion 25*a* is formed on one end portion of the upper side of the shaft 25. Then, in the upper yoke 51, the movable contactor 29, the lower yoke 52 and the presser plate 49, there are formed a through hole 51*a*, a through hole 29*a*, a through hole 52*c* and a through hole 49*a*, into which the shaft 25 is inserted, respectively.

Then, in the following manner, the movable contactor 29 is attached to one end portion of the shaft 25.

First, from the lower side, the movable iron core 17, the return spring 23, the presser plate 49, a contact pressure spring 33, the lower yoke 52, the movable contactor 29 and the upper yoke 51 are arranged in this order. At this time, the return spring 23 is inserted through the through hole 21*a* of the yoke upper plate 21 and the through hole 15*c* of the fixed iron core 15 in which the protrusion portion 15*a* is fitted to the through hole 14*c* of the plunger cap 14.

Then, from above the upper yoke 51, another end side of the shaft 25 is inserted through the respective through holes 51*a*, 29*a*, 52*c*, 31*a* and 49*a*, the contact pressure spring 33 and the return spring 23, and is then inserted through the movable iron core 17, whereby the shaft 25 is coupled thereto. In this embodiment, as shown in FIG. 1, such coupling of the shaft 25 to the movable iron core 17 is performed by crushing a tip end thereof and performing rivet coupling therefor. Note that a screw groove is formed on the other end portion of the shaft 25, and the shaft 25 is screwed into the movable iron core 17, whereby the shaft 25 may be coupled to the movable iron core 17.

In such a way, the movable contactor 29 is attached to the one end portion of the shaft 25.

Moreover, above the movable contactor 29, a pair of the fixed terminals 35, on which the fixed contact points 35*a* are individually provided, are arranged so as to be opposite to the movable contact points 29*b* provided on both end portions in a longitudinal direction of the movable contactor 29.

Then, a pair of the fixed terminals 35 are attached to through holes 41*a* formed in a base 41, whereby the fixed contact points 35*a* provided on lower end portions of the fixed terminals 35 protrude toward the movable contact points 29*b* of the movable contactor 29.

Then, the pair of fixed contact points 35*a* contact (abut against) the movable contact points 29*b*, whereby the fixed contact points 35*a* and the movable contact points 29*b* become conductive to each other. At this time, the contact pressure spring 33 presses the movable contactor 29, whereby the respective movable contact points 29*b* contact the fixed contact points 35*a* with predetermined contact pressure force. This contact pressure spring 33 is set so that a spring load thereof can be lower than that of the above-mentioned return spring 23. Therefore, in a state where the coil 13 is not energized and drive force is not imparted to the movable iron core 17, elastic force of the return spring 23 overcomes elastic force of the contact pressure spring 33, and the movable iron core 17 moves in the direction of leaving the fixed iron core 15 together with the movable contactor 29, and turns to a state of FIGS. 1(*a*) and 1(*b*). Moreover, the main terminals 10 are individually attached to the pair of fixed terminals 35.

The base 41 includes: a top wall 41*b* in which a pair of the through holes 41*a* are provided in parallel; and a square tube-like wall portion 41*c* erected from a peripheral edge of this top wall 41*b*. The base 41 is formed into a hollow box shape in which a lower side (movable contactor 29 side) is opened.

Then, in a state where the movable contactor 29 is housed in an inside of the wall portion 41*c* from such an opened lower side, the base 41 is fixed to the yoke upper plate 21 through a rectangular frame 40.

Moreover, on an outer peripheral side of the wall portion 41*c* of the base 41, a capsule yoke 30 with a substantially U-shape, to which a permanent magnet 31 is attached, is arranged opposite to the movable contactor 29. Then, the permanent magnet 31 is enabled to extend the arc, which occurs in the event where the movable contact points 29*b* of the movable contactor 29 and the fixed contact points 35*a* of the fixed terminals 35 contact and leave each other.

Next, a description is made of operations of the contact device 1.

First, in a state where the coil 13 is not energized, the elastic force of the return spring 23 overcomes the elastic force of the contact pressure spring 33, the movable iron core 17 moves in the direction of leaving the fixed iron core 15, and there is brought a state of FIGS. 1(*a*) and 1(*b*), where the movable contact points 29*b* leave the fixed contact points 35*a*.

When the coil 13 is energized from such an OFF state, then by the electromagnetic force, the movable iron core 17 moves to approach the fixed iron core 15 so as to be sucked to the fixed iron core 15 against the elastic force of the return spring 23. Following the movement of the movable iron core 17 to the upper side (fixed iron core 15 side), the shaft 25, and in addition, the upper yoke 51, the movable contactor 29 and the lower yoke 52, which are attached to the shaft 25, move to the upper side (fixed contact points 35*a* side). In such a way, the movable contact points 29*b* of the movable contactor 29 contact the fixed contact points 35*a* of the fixed terminals 35, and the respective contact points electrically conduct to each other, whereby the contact device 1 turns ON.

Incidentally, the movable contactor 29 is housed in an inside of the wall portion 41*c* of the base 41 so as to be movable relatively to the fixed terminals 35.

In this embodiment, the lower yoke 52 arranged so as to sandwich the movable contactor 29 is provided in contact with the contact pressure spring 33. Hence, in a case where the contact pressure spring 33 extends, and the lower yoke 52, the upper yoke 51 and the movable contactor 29 move toward the fixed terminal 35 side, then receiving rotation force in a rotation direction reverse to a winding direction of the spring, the lower yoke 52, the upper yoke 51 and the movable contactor 29 rotationally move in that reverse rotation direction. Moreover, in a case where the contact pressure spring 33 contracts, and the lower yoke 52, the upper yoke 51 and the movable contactor 29 move in the direction of leaving the fixed terminals 35, then receiving rotation force in the winding direction of the spring, the lower yoke 52, the upper yoke 51 and the movable contactor 29 rotationally move in such a positive rotation direction.

Accordingly, in this embodiment, the upper yoke 51 is allowed to abut against a wall surface 41*d* in the inside of the wall portion 41*c* of the base 41 in such an event where the lower yoke 52, the upper yoke 51 and the movable contactor 29 move rotationally, whereby the rotational movement of the lower yoke 52, the upper yoke 51 and the movable contactor 29 is regulated.

However, in a case where the shaft 25 is provided at a center of the upper yoke 51, and the shaft 25 is arranged so as to be located at a center of the base 41, it is apprehended that such a problem as follows may occur. That is to say, in the event where the lower yoke 52, the upper yoke 51 and the movable contactor 29 move rotationally, it is apprehended that edges arranged diagonally on the upper yoke 51 may individually abut against mutually opposite wall surfaces (for example, in FIG. 3, a left wall surface 41*d*L and a right wall surface 41*d*R, which form long sides) of the wall surface 41*d* of the wall portion 41*c*. As described above, when the diagonally arranged edges abut against the mutually opposite wall surfaces of the wall surface 41*d* of the wall portion 41*c*, so-called inward biting occurs, and operation characteristics of the movable contactor 29 is deteriorated.

Accordingly, in this embodiment, it is made possible to more surely ensure the operation characteristics of the movable contactor 29 while regulating the rotational movement of the lower yoke 52, the upper yoke 51 and the movable contactor 29.

Figure 3:
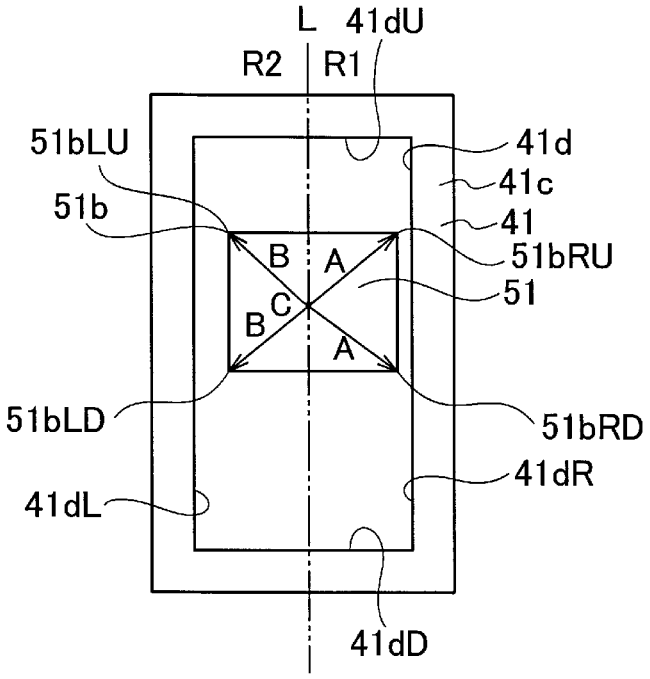
FIG. 3 is a plan view schematically showing the upper yoke and a base according to the first embodiment of the present invention.

Specifically, as shown in FIG. 3, in the event where the movable contactor 29 with the yoke 50 attached moves rotationally, the yoke 50 is allowed to abut against only the wall surface 41*d* in one region R1 obtained by dividing the entire wall surface 41*d* by a virtual line L passing through the rotation center C of the yoke 50.

In this embodiment, a shape profile of the wall surface 41*d* is quadrangular (polygonal), and this wall surface 41*d* has an upper wall surface 41*d*U, a lower wall surface 41*d*D, a left wall surface 41*d*L, and a right wall surface 41*d*R. Then, the wall surface 41*d* is divided into the region R1 on the right side and a region R2 on the left side by the virtual line L, which passes through the rotation center (region attached with the shaft 25 of the yoke 50) C of the yoke 50 and extends in an up-and-down direction of FIG. 3. That is to say, the wall surface 41*d* present in the region R1 on the right side is composed of: a right side of the upper wall surface 41*d*U; a right side of the lower wall surface 41*d*D; and the right wall surface 41*d*R. Moreover, the wall surface 41*d* present in the region R2 on the left side includes: a left side of the upper wall surface 41*d*U; a left side of the lower wall surface 41*d*D; and the left wall surface 41*d*L. Note that the above-mentioned virtual line L is merely an example, and a direction of the virtual line can be set at an arbitrary direction.

Then, in whichever direction the movable contactor 29 may rotationally move, the yoke 50 is allowed to abut against only the wall surface 41*d* present in the region R1 on the right side, and the yoke 50 is not allowed to abut against the wall surface 41*d* present in the region R2 on the left side.

Furthermore, in this embodiment, the yoke 50 is allowed to abut against only the wall surface 41*d*R that is a part of the wall surface 41*d* present in the region R1 on the right side. This wall surface 41*d*R is a flat surface that does not have a bent portion. Moreover, the right wall surface 41*d*R is a wall surface of a wall portion that composes one side of a quadrangle (polygon).

Meanwhile, as mentioned above, the yoke 50 is composed of the upper yoke (first yoke) 51 arranged on the movable contactor 29; and the lower yoke (second yoke), which surrounds the lower side and side portion of the movable contactor 29.

Then, the upper yoke 51 has a substantially quadrangular (polygonal) shape profile with four edges 51*b* formed. The four edges 51*b* are individually an upper right edge 51*b*RU, a lower right edge 51*b*RD, an upper left edge 51*b*LU, and a lower left edge 51*b*LD. Then, in an event where the movable contactor 29 rotationally moves clockwise in FIG. 3, the upper right edge 51*b*RU of the upper yoke 51 is allowed to abut against the right wall surface 41*d*R. At this time, none of other edges (lower right edge 51*b*RD, upper left edge 51*b*LU, lower left edge 51*b*LD) is allowed to abut against the wall surface 41*d*. Moreover, in an event where the movable contactor 29 rotationally moves counterclockwise in FIG. 3, the lower right edge 51*b*RD of the upper yoke 51 is allowed to abut against the right wall surface 41*d*R. At this time, none of other edges (upper right edge 51*b*RU, upper left edge 51*b*LU, lower left edge 51*b*LD) is allowed to abut against the wall surface 41*d*.

In order to adopt such a configuration, in this embodiment, a distance of the edge, which is opposite to the right wall surface (one wall surface) 41*d*R, to the rotation center C and a distance of the edge, which is opposite to the wall surface (left wall surface 41*d*L) on an opposite side with the right wall surface (one wall surface) 41*d*R, to the rotation center C are differentiated from each other.

That is to say, the distance to the rotation center C of the yoke 50 is differentiated between the upper and lower right edges 51*b*RU and 51*b*RD and the upper and lower left edges 51*b*LU and 51*b*LD.

Specifically, a distance A from the upper right edge 51*b*RU and the lower right edge 51*b*RD to the rotation center C of the yoke 50 is set larger than a distance B from the upper left edge 51*b*LU and the lower left edge 51*b*LD to the rotation center C of the yoke 50.

The above-described configuration can be obtained by shifting the center of the upper yoke 51 to the right wall surface 41*d*R side (wall surface side against which the edges are allowed to abut) from the rotation center C.

Figure 4:
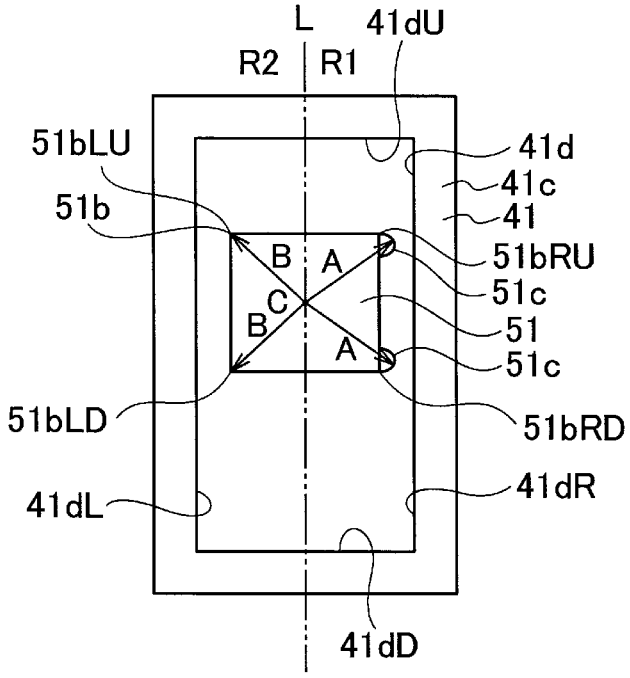
FIG. 4 is a plan view schematically showing an upper yoke and a base according to a modification example of the first embodiment of the present invention.

Note that, as shown in FIG. 4, protrusion portions 51*c*, which protrude to the right wall surface (one wall surface) 41*d*R side, are individually provided on the upper right edge 51*b*RU and the lower right edge 51*b*RD, whereby the distance to the rotation center C can also be differentiated between right and left. In a case where such a configuration is adopted, in the event where the movable contactor 29 moves rotationally, only either of the protrusion portions 51*c* abuts against the right wall surface (one wall surface) 41*d*R, and the rotational movement of the upper yoke 51 is regulated.

Figure 5:
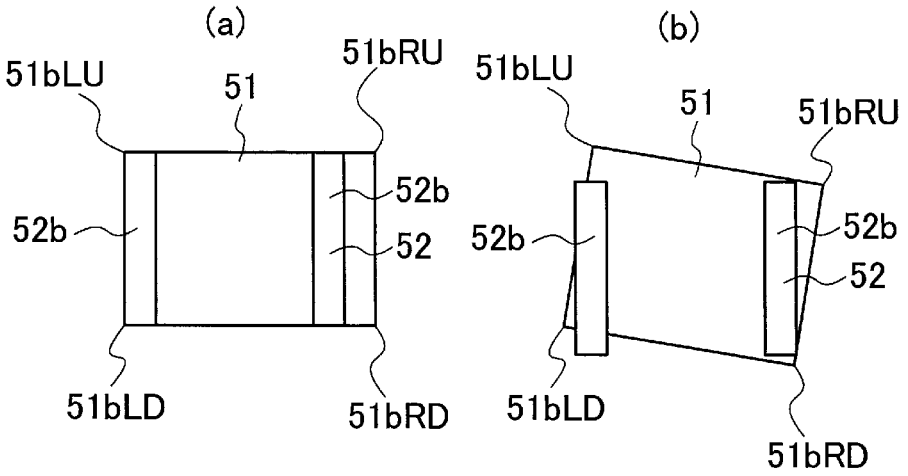
FIGS. 5(*a*) and 5(*b*) are views explaining a positional relationship between the upper yoke and the lower yoke according to the first embodiment of the present invention.

Moreover, in this embodiment, with regard to the upper yoke 51, as shown in FIGS. 5(*a*) and 5(*b*), a side thereof in the one region R1, which is opposite to the wall surface (right wall surface 41*d*R) against which the upper yoke 51 abuts, protrudes more on the wall surface 41*d*R side than the lower yoke 52 when viewed from the above.

Specifically, the whole of the right side (side on which the upper right edge 51*b*RU and the lower right edge 51*b*RD are formed) of the upper yoke 51 is allowed to protrude more on the right side (right wall surface 41*d*R side) than the upper end surface of the right-side sidewall portion 52*b* of the lower yoke 52.

As described above, in this embodiment, in the event where the movable contactor 29 with the yoke 50 attached moves rotationally, the yoke 50 is allowed to abut against only the wall surface in the one region R1 obtained by dividing the wall surface 41*d* by the virtual line L passing through the rotation center C of the yoke 50.

By adopting such a configuration, the yoke 50 can be prevented from abutting against the wall surface 41*d* at two spots arranged so as to sandwich the rotation center C therebetween. As a result, the operation characteristics of the movable contactor 29 are suppressed from being deteriorated, and it becomes possible to more surely ensure the operation characteristics of the movable contactor 29.

Moreover, in whichever direction the movable contactor 29 may rotationally move, the yoke 50 is allowed to abut against only the wall surface 41*d*R. As described above, the yoke 50 is allowed to abut against the right wall surface 41*d*R, whereby the so-called inward biting is further suppressed from occurring, and it becomes possible to more surely ensure the operation characteristics of the movable contactor 29. In particular, in this embodiment, the yoke 50 is allowed to abut against (brought into line contact with) only the right wall surface 41*d*R, which is the flat surface that does not have a bent portion, and is the wall surface of the wall portion that composes one side of the quadrangle (polygon), at one spot, and accordingly, the so-called inward biting does not occur, and the operation characteristics of the movable contactor 29 can be ensured more surely.

Moreover, as shown in FIG. 4, if the protrusion portions 51*c*, which protrude to the right wall surface (one wall surface) 41*d*R side, are individually provided on the upper right edge 51*b*RU and the lower right edge 51*b*RD, then the rotational movement of the movable contactor 29 can be more surely regulated by the protrusion portions 51*c*. At this time, if a shape of the protrusion portions 51*c* is made hemispheric, the protrusion portions 51*c* are brought into point contact with the right wall surface 41*d*R.

Moreover, as shown in FIGS. 5(*a*) and 5(*b*), the upper yoke 51 is formed so that the side thereof in the one region R1, which is opposite to the wall surface 41*d*R against which the upper yoke 51 abuts, can protrude more on the wall surface 41*d*R side than the lower yoke 52 when viewed from the above, then the following effects can be exerted.

If the movable contactor 29 moves rotationally, and the upper yoke 51 abuts against the right wall surface 41*d*R, then there is a possibility that the upper yoke 51 may rotationally move relatively to the lower yoke 52 and the movable contactor 29. However, if the configuration of FIGS. 5(*a*) and 5(*b*) is adopted, then an opposite area of the upper yoke 51 and the lower yoke 52 can be suppressed from being reduced even if the upper yoke 51 rotationally moves relatively to the lower yoke 52.

Figure 6:
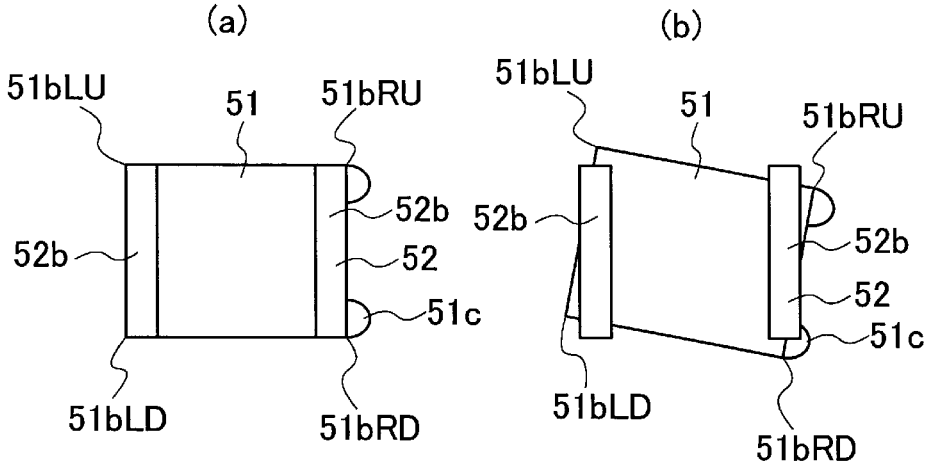
FIGS. 6(*a*) and 6(*b*) are views explaining a positional relationship between the upper yoke and the lower yoke according to the modification example of the first embodiment of the present invention.

That is to say, as shown in FIG. 4, if only the protrusion portions 51*c* are provided on the portion of the edges 51*b*, then when the upper yoke 51 rotationally moves relatively to the lower yoke 52, a region that does not become opposite to the lower yoke 52 is formed also on the right side as shown in FIG. 6(*b*).

On the other hand, if the configuration of FIGS. 5(*a*) and 5(*b*) is adopted, then as shown in FIG. 5(*b*), the upper yoke 51 can maintain such a state of being opposite to the lower yoke 52 (reduce an area of such a non-opposite portion more than in the configuration of FIG. 4) on the right side. As a result, the opposite area of the upper yoke 51 and the lower yoke 52 can be suppressed from being reduced. As described above, the reduction of the opposite area is suppressed, whereby an overcurrent capacity is suppressed from being reduced, and it becomes possible to suppress the contact points from being welded to each other owing to the occurrence of the arc.

Second Embodiment

A contact device 1 according to this embodiment basically has a similar configuration to that of the above-described first embodiment. That is to say, the contact device 1 according to this embodiment also has the configuration shown in FIGS. 1(*a*) and 1(*b*) and FIG. 2.

Moreover, also in this embodiment, the upper yoke 51 is allowed to abut against the wall surface 41*d* in the inside of the wall portion 41*c* of the base 41 in the event where the lower yoke 52, the upper yoke 51 and the movable contactor 29 move rotationally, whereby the rotational movement of the lower yoke 52, the upper yoke 51 and the movable contactor 29 is regulated.

Furthermore, also in this embodiment, it is made possible to more surely ensure the operation characteristics of the movable contactor 29 while regulating the rotational movement of the lower yoke 52, the upper yoke 51 and the movable contactor 29.

Here, in this embodiment, the virtual line L is set so that portions of the wall surface 41*d*, which are opposite to each other, can be present in the one region R1 obtained by dividing the entire wall surface 41*d* by the virtual line L.

Figure 7:
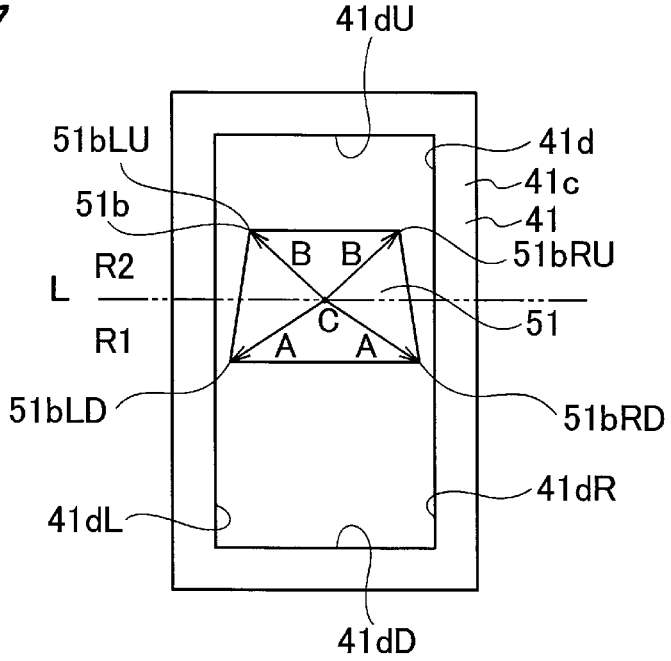
FIG. 7 is a plan view schematically showing an upper yoke and a base according to a second embodiment of the present invention.

Then, as shown in FIG. 7, in the event where the movable contactor 29 with the yoke 50 attached moves rotationally, the yoke 50 is allowed to abut against only the wall surface 41*d* in the one region R1 obtained by dividing the entire wall surface 41*d* by the virtual line L passing through the rotation center C of the yoke 50.

Specifically, in this embodiment, a shape profile of the wall surface 41*d* is quadrangular (polygonal), and this wall surface 41*d* has an upper wall surface 41*d*U, a lower wall surface 41*d*D, a left wall surface 41*d*L, and a right wall surface 41*d*R. Then, the wall surface 41*d* is divided into the region (one region) R1 on a lower side and a region (other region) R2 on an upper side by the virtual line L, which passes through the rotation center (a region to which the shaft 25 of the yoke 50 is attached) C of the yoke 50 and extends in an right-and-left direction of FIG. 7. That is to say, the wall surface 41*d* present in the region R1 on the lower side includes: a lower side of the left wall surface 41*d*L; a lower side of the right wall surface 41*d*R; and the lower wall surface 41*d*D. Moreover, the wall surface 41*d* present in the region R2 on the upper side includes: an upper side of the left wall surface 41*d*L; an upper side of the lower wall surface 41*d*R; and the upper wall surface 41*d*U. Then, the lower side of the left wall surface 41*d*L and the lower side of the right wall surface 41*d*R are the portions of the wall surface 41*d*, which are opposite to each other. Note that the above-mentioned virtual line L is merely an example, and a direction of the virtual line can be set at an arbitrary direction as long as the wall surface 41*d* can be divided so that the portions of the wall surfaces 41*d*, which are opposite to each other, can be present in the one region R1.

Then, in whichever direction the movable contactor 29 may rotationally move, the yoke 50 is allowed to abut against only the wall surface 41*d* present in the region R1 on the lower side, and the yoke 50 is not allowed to abut against the wall surface 41*d* present in the region R2 on the upper side.

Furthermore, in an event where the movable contactor 29 with the yoke 50 attached rotationally moves clockwise (toward one side), the yoke 50 is allowed to abut against only one wall surface (lower side of the left wall surface 41*d*L) of such wall surfaces (lower side of the left wall surface 41*d*L and lower side of the right wall surface 41*d*R) opposite to each other.

Meanwhile, in an event where the movable contactor 29 attached with the yoke 50 rotationally moves counterclockwise (toward other side), the yoke 50 is allowed to abut against only other wall surface (lower side of the right wall surface 41*d*R) of the wall surfaces opposite to each other.

That is to say, in the event where the movable contactor 29 with the yoke 50 attached rotationally moves in either of the directions, the yoke 50 is allowed to abut against only either of the portions of the wall surface 41*d*, which are opposite to each other, in the one region R1 obtained by dividing the entire wall surface 41*d* by the virtual line L passing through the rotation center C of the yoke 50.

Meanwhile, as mentioned above, the yoke 50 includes the upper yoke (first yoke) 51 arranged on the movable contactor 29; and the lower yoke (second yoke), which surrounds the lower side and side portion of the movable contactor 29.

Then, the upper yoke 51 has a substantially quadrangular (polygonal) shape profile, and four edges 51*b* are formed. The four edges 51*b* are individually an upper right edge 51*b*RU, a lower right edge 51*b*RD, an upper left edge 51*b*LU, and a lower left edge 51*b*LD. Then, in an event where the movable contactor 29 rotationally moves clockwise in FIG. 7, the lower left edge 51*b*LD of the upper yoke 51 is allowed to abut against the lower side of the left wall surface 41*d*L. At this time, none of other edges (upper right edge 51*b*RU, lower right edge 51*b*RD, upper left edge 51*b*LU) is allowed to abut against the wall surface 41*d*. Moreover, in an event where the movable contactor 29 rotationally moves counterclockwise in FIG. 7, the lower right edge 51*b*RD of the upper yoke 51 is allowed to abut against the lower side of the right wall surface 41*d*R. At this time, none of other edges (upper right edge 51*b*RU, upper left edge 51*b*LU, lower left edge 51*b*LD) is allowed to abut against the wall surface 41*d*.

In order to adopt such a configuration, in this embodiment, a distance of the edge 51*b*, which is opposite to the wall surface 41*d* of the one region R1, to the rotation center C and a distance of the edge 51*b*, which is opposite to the wall surface 41*d* of the other region R2, to the rotation center C are differentiated from each other.

That is to say, the distance to the rotation center C of the yoke 50 is differentiated between the upper right and left edges 51*b*RU and 51*b*LU and the lower right and left edges 51*b*RD and 51*b*LD.

Specifically, the shape profile of the upper yoke 51 is formed into a trapezoidal shape in which a width (distance between the lower right edge 51*b*RD and the lower left edge 51*b*LD) between the edges of the one region R1 side is made wider (larger) than a width (distance between the upper right edge 51*b*RU and the upper left edge 51*b*LU) between the edges of the other region R2.

In such a way, a distance A from the lower right edge 51*b*RD and the lower left edge 51*b*LD to the rotation center C of the yoke 50 is set larger than a distance B from the upper right edge 51*b*RU and the upper left edge 51*b*LU to the rotation center C of the yoke 50.

Figure 8:
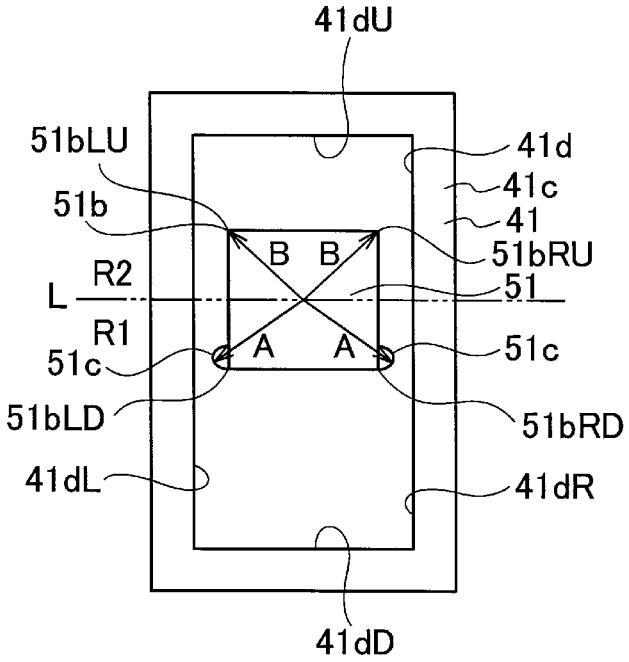
FIG. 8 is a plan view schematically showing an upper yoke and a base according to a modification example of the second embodiment of the present invention.

Note that, as shown in FIG. 8, a protrusion portion 51*c*, which protrudes to the right wall surface (one of the opposite wall surfaces) 41*d*R side, may be provided on the lower right edge 51*b*RD, and a protrusion portion 51*c*, which protrudes to the left wall surface (other of the opposite wall surfaces) 41*d*L side, may be provided on the lower left edge 51*b*LD. Also in such a way, the distance to the rotation center C can be differentiated between the upper side and the lower side. Where such a configuration is adopted, when the movable contactor 29 moves rotationally, only either of the protrusion portions 51*c* abuts against either of the mutually opposite portions of the wall surface 41*d* of the one region R1, and the rotational movement of the upper yoke 51 is regulated.

Figure 9:
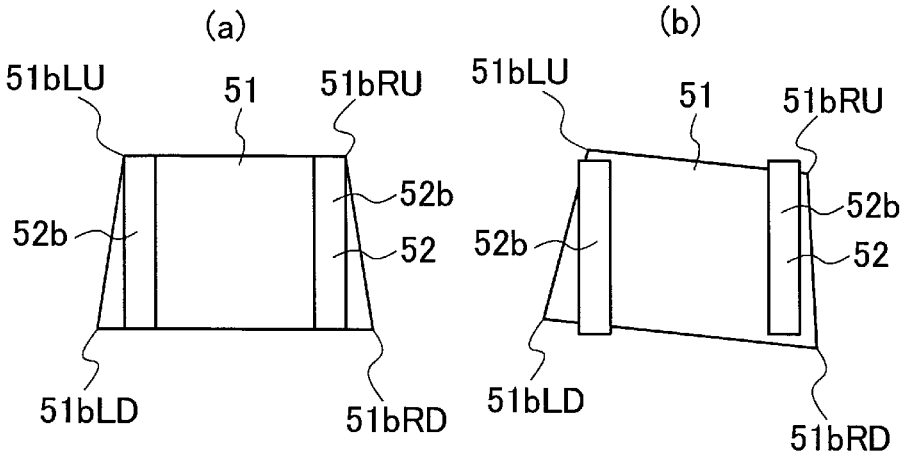
FIGS. 9(*a*) and 9(*b*) are views explaining a positional relationship between the upper yoke and a lower yoke according to the second embodiment of the present invention.

Furthermore, in this embodiment, as shown in FIGS. 9(*a*) and 9(*b*), the upper yoke 51 is arranged so that the edges 51*b* thereof on the one region R1 side can protrude more on the wall surface 41*d* side, of which portions are opposite to each other in the one region R1, than the lower yoke 52.

Specifically, the lower right edge 51*b*RD of the upper yoke 51 is allowed to protrude more on the right side (right wall surface 41*d*R side) than the upper end surface of the right-side sidewall portion 52*b* of the lower yoke 52.

Meanwhile, the lower left edge 51*b*LD of the upper yoke 51 is allowed to protrude more on the left side (left wall surface 41*d*L side) than the upper end surface of the left-side sidewall portion 52*b* of the lower yoke 52.

Also by this embodiment, similar functions and effects to those of the above-described first embodiment can be exerted.

Moreover, according to this embodiment, in the event where the movable contactor 29 with the yoke 50 attached rotationally moves in either of the directions, the yoke 50 is allowed to abut against only either of the portions of the wall surface 41*d*, which are opposite to each other, in the one region R1 obtained by dividing the entire wall surface 41*d* by the virtual line L passing through the rotation center C of the yoke 50.

By adopting such a configuration, the yoke 50 can be prevented from abutting against the wall surface 41*d* at two spots arranged so as to sandwich the rotation center C. As a result, the operation characteristics of the movable contactor 29 are suppressed from being deteriorated, and it becomes possible to more surely ensure the operation characteristics of the movable contactor 29.

Moreover, the yoke 50 is allowed to abut against only either one of the portions of the wall surface 41*d*, which are opposite to each other in the one region R1, whereby the so-called inward biting is further suppressed from occurring, and it becomes possible to more surely ensure the operation characteristics of the movable contactor 29. In particular, in this embodiment, the yoke 50 is allowed to abut against (brought into line contact with) the right wall surface 41*d*R or the left wall surface 41*d*L, which is the flat surface that does not have a bent portion, at one spot, and accordingly, the so-called inward biting does not occur, and the operation characteristics of the movable contactor 29 can be ensured more surely.

Moreover, as shown in FIG. 8, if the protrusion portion 51*c*, which protrudes to the right wall surface (one of the opposite wall surfaces) 41*d*R side, is provided on the lower right edge 51*b*RD, and the protrusion portion 51*c*, which protrudes to the left wall surface (the other of the opposite wall surfaces) 41*d*L side, is provided on the lower left edge 51*b*LD, then the rotational movement of the movable contactor 29 can be more surely regulated by the protrusion portions 51*c*. At this time, if a shape of the protrusion portions 51*c* is made hemispheric, the protrusion portions 51*c* are brought into point contact with the right wall surface 41*d*R.

Moreover, as shown in FIGS. 9(*a*) and 9(*b*), if the upper yoke 51 is arranged so that the edges 51*b* thereof on the one region R1 side can protrude more on the wall surface 41*d* side, of which portions are opposite to each other in the one region R1, than the lower yoke 52, then the following effects can be exerted.

If the movable contactor 29 moves rotationally, and the upper yoke 51 abuts against the right wall surface 41*d*R and the left wall surface 41*d*L, then there is a possibility that the upper yoke 51 may rotationally move relatively to the lower yoke 52 and the movable contactor 29. However, if the configuration of FIGS. 9(*a*) and 9(*b*) is adopted, then an opposite area of the upper yoke 51 and the lower yoke 52 can be suppressed from being reduced even if the upper yoke 51 rotationally moves relatively to the lower yoke 52.

Figure 10:
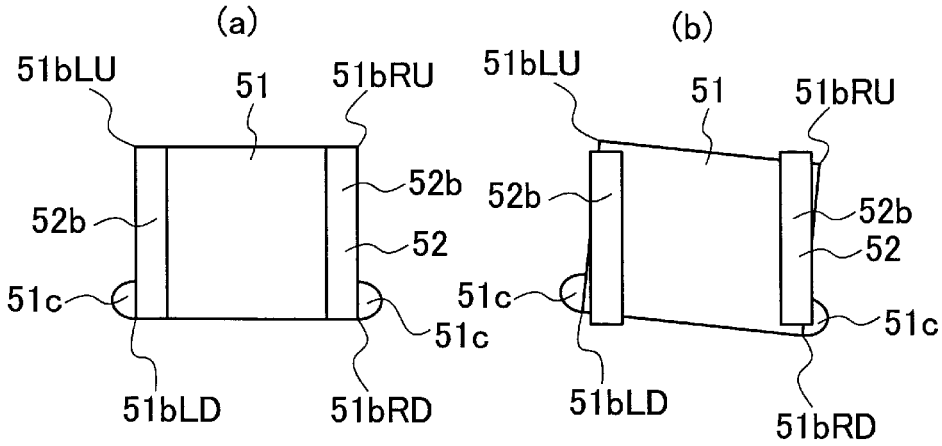
FIGS. 10(*a*) and 10(*b*) are views explaining a positional relationship between the upper yoke and a lower yoke according to the modification example of the second embodiment of the present invention.

That is to say, as shown in FIG. 8, if only the protrusion portions 51*c* are provided on the portion of the edges 51*b*, then when the upper yoke 51 rotationally moves relatively to the lower yoke 52, a region that does not become opposite to the lower yoke 52 is formed much as shown in FIG. 10(*b*).

As opposed to this, if the configuration of FIGS. 9(*a*) and 9(*b*) is adopted, then as shown in FIG. 9(*b*), the reduction of the opposite area of the upper yoke 51 to the lower yoke 52 can be suppressed (such an area of the non-opposite portion can be reduced more in the configuration of FIG. 8). As a result, the opposite area of the upper yoke 51 and the lower yoke 52 can be suppressed from being reduced. As described above, the reduction of the opposite area is suppressed, whereby the overcurrent capacity is suppressed from being reduced, and it becomes possible to suppress the contact points from being welded to each other owing to the occurrence of the arc.

The description has been made above of the preferred embodiments of the present invention; however, the present invention is not limited to the above-described embodiments, and is modifiable in various ways.

For example, in the above-described first embodiment, one spot of the yoke is allowed to abut against only the right wall surface that composes one side of the quadrangle that is the shape profile; however, such an abutment spot may be plural. For example, such a configuration may be adopted, in which a plurality of the protrusion portions are provided on each of both of the upper and lower ends, and the plurality of protrusion portions on the upper side or the plurality of protrusion portions on the lower side abut against the right wall surfaces in the event where the movable contactor moves rotationally.

Moreover, the shape profile of the wall surface against which the yoke is allowed to abut is not limited to such a linear shape, and may be curved. Furthermore, the shape profile of the wall surface may be ellipsoidal or circular. As described above, in a case where the shape profile of the wall surface is ellipsoidal or circular, a circular arc portion in which a central angle is 180 degrees or less just needs to be set, and the yoke just needs to be allowed to abut against only a wall surface that composes the circular arc portion.

Furthermore, in the above-described first embodiment, the one is illustrated, in which a part of the yoke is brought into point contact or line contact with the wall surface; however, a part of the yoke may be brought into surface contact therewith. In a case of the shape in this embodiment described above, for example, the shape of the yoke can be formed into a shape with the upper right and lower right edge portions cut away, and portions from which the edge portions are cut away can be brought into surface contact with the wall surface when the yoke moves rotationally.

Moreover, in the above-described first embodiment, the wall portion in which the shape profile is quadrangular is illustrated; however, the wall portion may have a polygonal shape in which the shape profile is triangular or pentagonal or polygonal with more sides. At this time, preferably, the yoke is allowed to abut against the wall surface of the wall portion, which composes one side. Note that, in a case where the shape profile of the wall portion is pentagonal or polygonal with more sides, the yoke is not allowed to abut against the same wall portion in both of the rotational movements which are clockwise and counterclockwise, but in each of the rotational movements, the yoke can be allowed to abut against the wall surface of the wall portion, which composes one side. For example, in a case where the shape profile of the wall portion is hexagonal, the yoke can be allowed to abut against a wall surface, which composes an obliquely upper right side, in the case where the yoke is rotationally moved clockwise, and the yoke can be allowed to abut against a wall surface, which composes an obliquely lower right side, in the case where the yoke is rotationally moved counterclockwise.

Moreover, in the above-described first embodiment, the yoke is allowed to abut against only the right wall surface; however, the yoke may be allowed to simultaneously abut against the wall surfaces of the wall portion, which are adjacent to each other. This case is illustrated in the above-described embodiment in which the profile shape is quadrangular. In the event where the yoke is formed into such a shape where the upper right edge portion is cut away, and the movable contactor rotationally moves clockwise, then both ends of the edge thus subjected to the cutting can be allowed to individually abut against the upper wall surface and the right wall surface. When such a configuration is adopted, the possibility that the operation characteristics may be deteriorated will increase in comparison with the above-described embodiment; however, such a situation is eliminated, where the yoke abuts against the wall surface at two spots arranged so as to sandwich the rotation center therebetween. That is to say, in an event where the yoke is divided into halves by a straight line perpendicular to a line passing through the rotation center and connecting one of such contact portions and the rotation center to each other, other of the contact portions contact the wall surface on the same side as that for the one of the contact portions. Therefore, in comparison with the case where the yoke abuts against the wall surface at two spots arranged so as to sandwich the rotation center therebetween, the so-called inward biting can be suppressed from occurring. Hence, even if two spots of the yoke are allowed to abut against the wall surfaces of the wall portion, which compose the sides adjacent to each other, the operation characteristics of the movable contactor can be ensured more surely.

Moreover, in the above-described second embodiment, one spot of the yoke is allowed to abut against the wall surface; however, such an abutment spot may be plural. For example, such a configuration may be adopted, in which a plurality of the protrusion portions are provided so as to be arrayed in parallel up and down, and the plurality of protrusion portions on the right side and the plurality of protrusion portions on the left side abut against the wall surfaces in the event where the movable contactor moves rotationally.

Moreover, the shape profile of the wall surface against which the yoke is allowed to abut is not limited to such a linear shape, and may be curved. Furthermore, the shape profile of the wall surface may be ellipsoidal or circular. As described above, in a case where the shape profile of the wall surface is ellipsoidal or circular, mutually opposite two circular arc portions, in each of which a central angle is 90 degrees or less, just need to be set, and the yoke just needs to be allowed to abut against only wall surfaces which compose the circular arc portions.

Furthermore, in the above-described second embodiment, the one is illustrated, in which a part of the yoke is brought into point contact or line contact with the wall surfaces, but it may be brought into surface contact.

Moreover, in the above-described first embodiment, the wall portion in which the shape profile is quadrangular is illustrated; however, the wall portion may have a polygonal shape in which the shape profile is triangular or pentagonal or polygonal with more sides. At this time, preferably, the wall surface against which the yoke is allowed to abut at the time of the clockwise rotational movement and the wall surface against which the yoke is allowed to abut at the time of the counterclockwise rotational movement are the wall surfaces of the wall portion, which are opposite to each other. For example, in a case where the shape profile of the wall portion is hexagonal, the yoke can be allowed to abut against a wall surface, which composes obliquely lower right and left sides, in the case where the yoke is rotationally moved clockwise, and the yoke can be allowed to abut against a wall surface, which composes an obliquely lower right side, in the case where the yoke is rotationally moved counterclockwise.

Moreover, the yoke (upper yoke) can also be formed into a polygonal, circular or ellipsoidal shape.

Moreover, such a configuration may be adopted, in which the upper yoke is formed into a U-shape and sandwiches the movable contactor therein, and the lower yoke is formed into a plate shape and is allowed to abut against the wall surface. Furthermore, such a configuration may be adopted, in which both of the upper yoke and the lower yoke are formed into a U-shape, and each of which sandwiches the movable contactor therein. In such a way, the rotational movement of the upper yoke with respect to the lower yoke can be suppressed.

Furthermore, the specifications (shapes, sizes, layout and the like) of other details such as movable terminals and fixed terminals are also changeable as appropriate.

INDUSTRIAL APPLICABILITY

According to the present invention, the contact device can be obtained, which is capable of ensuring the operation characteristics of the movable contactor more surely.

The invention claimed is:

1. A contact device comprising:

a movable contactor;

a yoke that is attached to the movable contactor and forms a magnetic circuit; and a wall portion arranged to surround outer peripheries of the movable contactor and the yoke, wherein:

rotational movement of the movable contactor with the yoke attached is regulated by a fact that the yoke abuts against a wall surface of the wall portion, in an event where the movable contactor with the yoke attached moves rotationally, the yoke is allowed to abut against only a wall surface in one region obtained by dividing the wall surface by a virtual line passing through a rotation center of the yoke, the wall surface in the one region includes wall surfaces opposite to each other so as to interpose the yoke therebetween, the yoke abuts against only one wall surface of the wall surfaces opposite to each other in an event where the movable contactor attached with the yoke rotationally moves to one side, and the yoke abuts against only other wall surface of the wall surfaces opposite to each other in an event where the movable contactor with the yoke attached rotationally moves to another side.

2. The contact device according to claim 1, wherein, in whichever direction the movable contactor with the yoke attached may rotationally move, the yoke is allowed to abut against only the wall surface in the one region.

3. The contact device according to claim 1, wherein the wall surface against which the yoke abuts does not have a bent portion.

4. The contact device according to claim 3, wherein a shape profile of the wall surface has a polygonal shape, and the yoke is allowed to abut against only a wall surface of the wall portion, the wall surface composing one side of the polygonal shape.

5. The contact device according to claim 4, wherein the shape profiles of the wall surface and the yoke have quadrangular shapes, and a distance of an edge of the yoke, the edge being opposite to one wall surface of four wall surfaces of the wall surface, to the rotation center and a distance of an edge of the yoke, the edge being opposite to a wall surface opposite to the one wall surface, to the rotation center are different from each other.

6. The contact device according to claim 5, wherein, on the edge opposite to the one wall surface of the four wall surfaces of the wall surface, a protrusion portion that protrudes on the one wall surface side is provided.

7. The contact device according to claim 1, wherein the yoke includes: a first yoke that abuts against the wall surfaces; and a substantially U-like second yoke arranged to surround the movable contactor, and a side of the first yoke in the one region, the side being opposite to the wall surface against which the first yoke abuts, protrudes more on the wall surface side than the second yoke when viewed from above.

8. The contact device according to claim 1, wherein the shape profiles of the wall surface and the yoke have quadrangular shapes, and a distance of an edge of the yoke, the edge being opposite to a wall surface in the one region, to the rotation center and a distance of an edge of the yoke, the edge being opposite to a wall surface in other region, to the rotation center are different from each other.

9. The contact device according to claim 8, wherein, on the edge opposite to the wall surface in the one region, protrusion portions which protrude to a mutually opposite wall surface side in the one region are individually provided.

10. The contact device according to claim 8, wherein the yoke includes: a first yoke that has a quadrangular shape profile and abuts against the wall surfaces; and a substantially U-like second yoke arranged to surround the movable contactor, and the shape profile of the first yoke has a trapezoidal shape in which a width between edges on the one region side is made wider than a width between edges on the other region.

11. The contact device according to claim 10, wherein the edges of the first yoke on the one region side protrude more on the mutually opposite wall surface side in the one region than the second yoke.

12. A contact device comprising:

a movable contactor;

a yoke that is attached to the movable contactor and forms a magnetic circuit; and a wall portion arranged to surround outer peripheries of the movable contactor and the yoke, wherein:

rotational movement of the movable contactor with the yoke attached is regulated by a fact that the yoke abuts against a wall surface of the wall portion, in an event where the movable contactor with the yoke attached moves rotationally, the yoke is allowed to abut against only a wall surface in one region obtained by dividing the wall surface by a virtual line passing through a rotation center of the yoke, the wall surface in the one region includes wall surfaces opposite to each, the yoke abuts against only one wall surface of the wall surfaces opposite to each other in an event where the movable contactor attached with the yoke rotationally moves to one side, the yoke abuts against only other wall surface of the wall surfaces opposite to each other in an event where the movable contactor with the yoke attached rotationally moves to another side, the shape profiles of the wall surface and the yoke have quadrangular shapes, and a distance of an edge of the yoke, the edge being opposite to a wall surface in the one region, to the rotation center and a distance of an edge of the yoke, the edge being opposite to a wall surface in other region, to the rotation center are different from each other, and the yoke includes: a first yoke that has a quadrangular shape profile and abuts against the wall surfaces; and a substantially U-like second yoke arranged to surround the movable contactor, and the shape profile of the first yoke has a trapezoidal shape in which a width between edges on the one region side is made wider than a width between edges on the other region.

13. The contact device according to claim 12, wherein the edges of the first yoke on the one region side protrude more on the mutually opposite wall surface side in the one region than the second yoke.

* * * * *